United States Patent [19]

Stetson

[11] 3,942,684

[45] Mar. 9, 1976

[54] AIR ACCUMULATOR AND AERATOR FOR MATERIALS-HANDLING

[75] Inventor: Harold M. Stetson, Neponset, Ill.

[73] Assignee: Martin Engineering Co., Neponset, Ill.

[22] Filed: Apr. 10, 1975

[21] Appl. No.: 566,776

[52] U.S. Cl. ..... 222/3; 222/195

[51] Int. Cl.[2] ..... F17C 5/06

[58] Field of Search ..... 222/400.7, 504, 3, 4, 195; 124/11 R, 12; 220/85 S, 85 R, 85 VR, 85 VS

[56] References Cited

UNITED STATES PATENTS 2,763,397 9/1956 Rice ..... 222/3 X 3,788,527 1/1974 Matson ..... 222/389 X

*Primary Examiner*—Robert B. Reeves
*Assistant Examiner*—John P. Shannon

[57] ABSTRACT

A system for transferring a charge of air under high pressure from an accumulator or reservoir to a container of dispensable or flowable material of granular or like nature to facilitate flow or discharge of the material, as in cases where the material tends to "bridge" or "hang up" and create blockages as at the outlet of the container.

10 Claims, 6 Drawing Figures

AIR ACCUMULATOR AND AERATOR FOR MATERIALS-HANDLING

BACKGROUND OF THE INVENTION

One form of prior art system of this character forms the subject matter of assignee's U.S. Pat. No. 3,788,527, which depicts the manner in which an accumulator connected to a container via a discharge port is charged with compressed air by means of a valving system which closes off the discharge port while the accumulator is being charged, thus storing a certain volume of air under pressure. A quick-release valve connects the charged accumulator to the interior of the container and produces the equivalent of a dull "explosion" that effectively breaks up the bridged material.

In that patent, the aerator, which contains the valving, is a part of the accumulator in the sense that part of it is coaxially within the accumulator, which enables the achievement of certain advantages, as where it is desired to weld the discharge pipe to the container, one example being a relatively tall container in the form of a silo. In such a case, several aerator-accumulator units must be used where the silo volume is quite large, mainly because the welded-on construction does not readily permit changing a mounted unit to a new position.

In assignee's copending U.S. Pat. application Ser. No. 502,547, filed Sept. 9, 1974, the patented structure is improved to the extent that it provides separable flange mountings for the aerator so that, if required, the unit may be moved readily from one position to other positions. Also in that application, the valving system is changed to a coaxial piston seating on a stop or spacer included as a separable part of the flange-to-flange connection between the aerator body and the accumulator.

SUMMARY OF THE INVENTION

According to the present invention, improvements are provided over the patented and application structures, especially in the area of the relationship between the aerator piston valve and valve seat at the aerator-to-accumulator connection. More specifically, the valve seat is formed as part of the wall structure of the accumulator. One advantage here is that the accumulator may be provided with several mountings, each provided with a valve seat, closed off during non-use, but permitting the closures to be removed when a different position for the aerator is desired, as where the relationship of the accumulator to the container requires different positioning. In such case, each change of position of the aerator involves only re-mounting and not a separate valve seat.

Additionally, the accumulator wall structure is strengthened in the mounting area by plate-like structure including the valve seat and, still further, the plate structure has a counterbore into which a projecting cooperative part of the aerator is piloted, thus assuring coaxial alinement between the aerator piston valve and accumulator valve seat. Other features and advantages will appear as the disclosure is fully developed in connection with a preferred embodiment of the invention.

DESCRIPTION OF A PREFERRED EMBODIMENT

Figure 3:
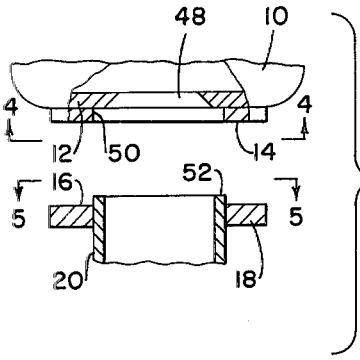
FIG. 3 is a two-part fragmentary view, partly in section, showing the pilot relationship of the valve seat counterbore and proximate end of the aerator body.

By way of illustration, an accumulator 10 comprises an elongated hollow cylindrical body having upper and lower end, the lower of which is provided with relatively heavy plate-like structure 12 affording a flat face portion 14 to abut a cooperative face 16 on a flange 18 forming a rigid part of an aerator body 20. The aerator body is cylindrically tubular and has at its end opposite the end provided with the flange 18 closure means in the form of an end plate 22 centrally bored and tapped to afford an air inlet 24 connectible, as by a line 26 to a source of compressed air 28. Interposed in the line 26 is a quick-release three-way valve 30. The flange is rigid with the accumulator-proximate end of the aerator body 20, preferably by being welded thereto, and the securing means for connecting the flange 18 to the accumulator may comprise cap screws 32, the plate structure 12 having a circle of tapped bores 34 and the flange 18 having a like circle of holes 36. See FIGS. 4 and 5.

The aerator body is provided intermediate its ends with a discharge port 38 and a discharge pipe 40 is rigidly secured as by welding to the body and projects laterally therefrom. In one use of the invention, the remote end of the pipe may have welded thereto a flange 42 connectible by cap screws 44 to the wall of a container 46, such as a silo, etc. for containing the flowable material.

Figure 2:
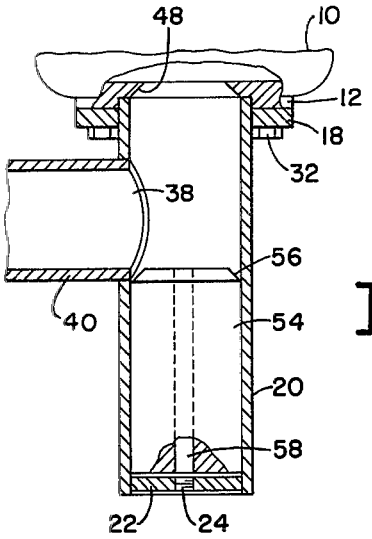
FIG. 2 is a fragmentary section of the aerator and lower portion of the aerator.
Figure 4:
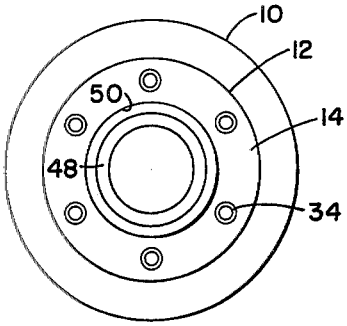
FIG. 4 is an end view as seen along the line 4—4 of FIG. 3.
Figure 5:
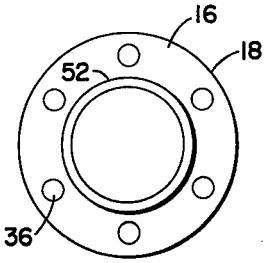
FIG. 5 is an end view as seen along the line 5—5 of FIG. 3.

As best seen in FIGS. 2, 3 and 4, the accumulator end structure 12 has a circular opening in the form of a valve seat 48, here of the truncated conical type having its larger area facing axially toward the aerator. The opening that includes the valve seat further has a larger counterbore 50. As seen in FIGS. 2, 3 and 5, the aerator body has an accumulator-proximate end portion 52 which projects axially beyond the upper face of the flange 18 to an extent enabling it to relatively tightly fit into the counterbore 50, thus providing a pilot during assembly of the aerator to the accumulator. The axial projection of this end portion beyond the flange is such that, when assembled, the faces 14 and 16 abut to establish an air-tight seal when the cap screws 32 are tightened.

A piston valve 54 is slidable in the interior of the aerator body and at its end proximate to the valve seat 48 has an annular portion 56 shaped to complement the valve seat. The piston valve has an axial passage 58 running end to end therethrough, and the length of the piston valve is such that when it is in the position shown in FIG. 2, the valve seat 48 and the discharge port 38 are uncovered. When the piston valve moves upwardly to seat on and close the valve seat, it also closes the discharge port, so that air under pressure from the source 28 flows only to the accumulator.

Figure 1:
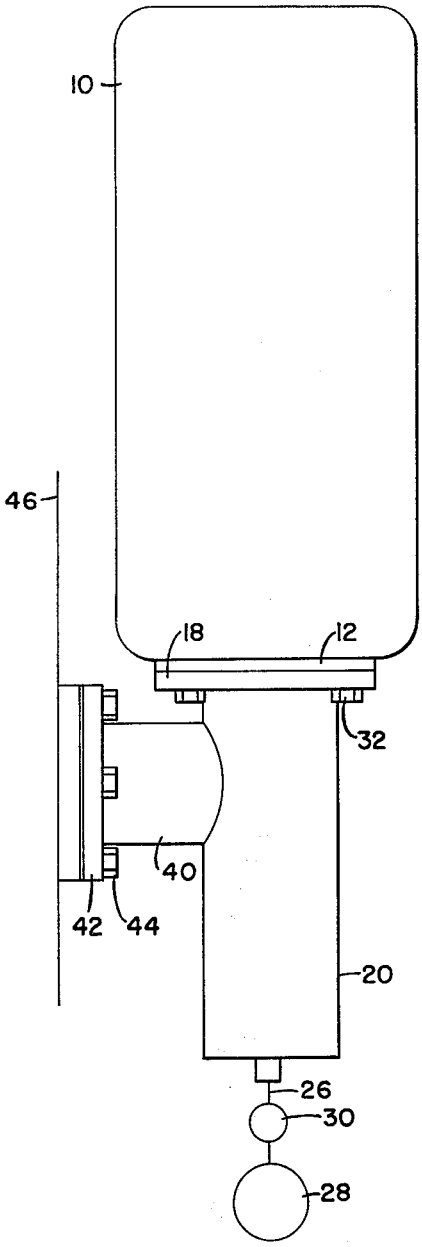
FIG. 1 is an elevation, with portions of the container broken away, illustrating one form of aerator-accumulator-container arrangement.

After the aerator has been assembled to the accumulator and container (FIG. 1), the operation is as follows: Assume that air compressor 28 is either not running or the three-way valve occupies a position where the inlet 24 is not being supplied with air, in which case, the piston valve 54 is in the position of FIG. 2; i.e., the valve seat and the discharge port are open.

When it is desired to charge the accumulator, and the air compressor is running and the valve 30 is in its "charge" position, air under pressure first raises the piston valve 34 to seat on and close the valve seat 48, at the same time closing the discharge port 38. The piston rises, of course, because of the area of the lower face thereof compared to the size of the passage 58. After the accumulator has been fully charged, the valve 30 is changed to its "hold" position, trapping air under the piston valve so that it remains in its closing or seating position. When the valve 30 is changed to its "release" position, exhausting the space under the piston valve 54 and discontinuing supply from the source 28, the piston valve returns rapidly to its FIG. 2 position, uncovering both the valve seat and discharge port and the sudden evacuation of the accumulator creates the dull "explosion" in the container 46.

Figure 6:
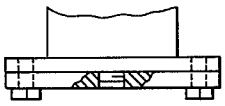
FIG. 6 is a fragmentary view, partly in section, showing a modified form of the invention in which the closure means at the inlet end of the aerator is removable.

In the modified form shown in FIG. 6, the aerator body 21 has at its lower or inlet end an integral flange 23 to which a closure means 25, like that at 22, is removably secured as by cap screws 27, thus enabling removal of the piston valve from that end without dismounting the aerator from the accumulator. The closure plate or means 27 has an air inlet corresponding to that at 24.

The foregoing are of course merely by way of illustration and it will be apparent that the preferred embodiment lends itself to many variations in structure and use.

I claim:

1. In combination: a compressed air accumulator including a tank-like structure having a wall provided with a circular opening and a flat face portion normal to the axis of the opening and surrounding the opening; an aerator including a hollow cylindrical body projecting from and normal to the face and coaxial with the opening and having one end proximate the opening and a second end remote from the opening, a mounting flange rigid with the one end and seating on the face portion with the opening and said one end in communication, closure means fixed to the other end of the body and having an inlet connectible to a source of air under pressure, said body having a lateral discharge port intermediate the ends of the body, and a piston valve slidably movable in the body between a first position adjacent to the closure means and uncovering both the opening and the discharge port and a second position closing both the discharge port and the opening, said piston valve having at one end a portion operative to close said opening in said second position; and means securing the flange to the accumulator face portion.

2. The invention defined in claim 1, further characterized in that the securing means is separable to enable removal of the aerator from the accumulator.

3. The invention defined in claim 1, further characterized in that the flat face portion is a plate member additional to and rigidly affixed to the wall portion.

4. The invention defined in claim 1, further characterized in that the circular opening is a valve seat and the piston valve has an end portion cooperative with the seat.

5. The invention defined in claim 4, in which the valve seat is of truncated conical form with its larger area facing the piston valve and the proximate end of the piston valve is cooperatively formed of truncated conical shape.

6. The invention defined in claim 4, further characterized in that the circular opening includes a counterbore of larger diameter than the valve seat and proximate to the aerator body and said body has its one end portion projecting axially beyond the mounting flange to fit within the counterbore.

7. The invention defined in claim 6, further characterized in that the amount of axial projection of said body end portion beyond the mounting flange is such that the mounting flange seats tightly against the accumulator face portion when assembled.

8. The invention defined in claim 1, in which the closure means is removably mounted on the aerator body.

9. The invention defined in claim 1 in which the other end of the aerator body has an annular flange rigid therewith and the closure means is affixed to the flange.

10. The invention defined in claim 9, in which the means affixing the closure means to the flange is separable.

* * * * *